US005594533A

United States Patent [19]

Katoh

[11] Patent Number: 5,594,533

[45] Date of Patent: Jan. 14, 1997

[54] IMAGE FORMING APPARATUS CAPABLE OF VARYING CHARGE AMOUNT IN ACCORDANCE WITH TONER DENSITY

[75] Inventor: Tetsuo Katoh, Tokyo, Japan

[73] Assignee: Kabushiki Kaisha Toshiba, Kawasaki, Japan

[21] Appl. No.: 493,568

[22] Filed: Jun. 22, 1995

[30] Foreign Application Priority Data

Jun. 30, 1994 [JP] Japan ..... 6-150177

[51] Int. Cl.[6] ..... G03G 15/02

[52] U.S. Cl. ..... 399/61; 399/50

[58] Field of Search ..... 355/208, 245, 355/246, 203–207, 209; 118/688–690

[56] References Cited

U.S. PATENT DOCUMENTS 4,318,610 3/1982 Grace ..... 355/246
4,468,112 8/1984 Suzuki et al. ..... 355/246
4,816,871 3/1989 Oushiden et al. .
5,006,896 4/1991 Koichi et al. ..... 355/246
5,250,959 10/1993 Yamada et al. ..... 347/132
5,315,352 5/1994 Nakane et al. ..... 355/246
5,402,209 3/1995 Itoyama et al. ..... 355/208

*Primary Examiner*—Thu A. Dang
*Attorney, Agent, or Firm*—Foley & Lardner

[57] ABSTRACT

A toner density sensor detects the state where a toner cartridge is empty and the toner density in a developing unit is therefore low. In accordance with the sensing output of the toner density sensor, the surface potential of a photosensitive drum is decreased. By this control, the carriers of the developing agent are prevented from being attracted onto the photosensitive drum during the period between the time when the toner cartridge becomes empty and the toner density begins to decrease and the time when the copying operation stops due to the toner empty state. Hence, the images formed during that period are not poor in quality.

8 Claims, 7 Drawing Sheets

IMAGE FORMING APPARATUS CAPABLE OF VARYING CHARGE AMOUNT IN ACCORDANCE WITH TONER DENSITY

BACKGROUND OF THE INVENTION

1. Field of the Invention

The present invention relates to an image forming apparatus, such as a copying machine, which forms a document image on a sheet of paper by use of a developing unit containing toner.

2. Description of the Related Art

In an image forming apparatus (e.g., a copying machine), the surface potential of a photosensitive drum is controlled (i.e., the charge amount is varied by means of a charging grid), but this is done intentionally for the express purpose of forming an image of desirable quality or for forming an image of the best quality in accordance with the environmental conditions, such as the temperature and moisture. In general, the surface potential of the photosensitive drum is not controlled in accordance with a variation in toner density.

A developing unit is regarded as being in a toner empty state when the toner density of the developing agent contained in the developing unit has decreased to a predetermined value. Therefore, during the period between the time when the toner cartridge becomes empty and the time when the copying operation stops due to the toner empty state, the toner density in the developing unit is inevitably lower than the normal toner density. Since, in this state, it is likely that carriers will be attracted or attached to the photosensitive drum, a defective image may be formed.

In the conventional art, even when an output of the toner density sensor is greater than a reference value (which is a center value [4 V] in the case of FIG. 1 and corresponds to the time when the toner cartridge becomes empty), and the toner density lowers, the surface potential of the photosensitive drum remains at a center value (−700 V), as shown in FIG. 1. Therefore, during the period between the time when the toner cartridge becomes empty and the time when the copying operation stops due to the toner empty state, the number of carriers attracted to the photosensitive drum gradually increases, as shown in FIG. 2. In other words, the number of white dots produced in an all-black image increases, thus adversely affecting the quality of the image.

It is known in the art that carriers are attracted to the photosensitive drum when the toner density is low and the surface potential of the photosensitive drum is high, as shown in FIG. 3.

Therefore, the image quality is degraded due to the carriers attracted to the photosensitive drum during the period between the time when the toner cartridge becomes empty and the time when the copying operation stops due to the toner empty state.

SUMMARY OF THE INVENTION

Accordingly, an object of the present invention is provide an image forming apparatus which prevents the carriers of the developing agent from being attracted to the photosensitive drum and can therefore form an image of good quality at all times, even during the period between the time when the toner cartridge becomes empty and the time when the copying operation stops due to the toner empty state.

According to one aspect of the present invention, there is provided an image forming apparatus comprising: an image bearing member for bearing an electrostatic latent image formed thereon; means, storing a developing agent including toner and carriers, for developing the electrostatic latent image formed on the image bearing member by supplying the toner to the electrostatic latent image; means, provided in the developing means, for sensing a toner density inside the developing means and for producing a sensing output; and means for charging the image bearing member such that the image bearing member has a surface potential corresponding to the sensing output produced by the density sensing means.

According to another aspect of the present invention, there is provided an image forming apparatus comprising: an image bearing member for bearing an electrostatic latent image formed thereon; means for charging the image bearing member; means, storing a developing agent including toner and carriers, for developing the electrostatic latent image formed on the image bearing member by supplying the toner to the electrostatic latent image; means, provided in the developing means, for sensing a toner density inside the developing means and for producing a sensing output; means for storing data on toner densities inside the developing means and data on surface potentials of the image bearing member in association with each other; and means for reading one of surface potential data corresponding to the toner density sensed by the density sensing means on the basis of the sensing output out of the memory means, and for controlling the charging means to charge the image bearing member such that the surface potential is corresponding to the surface potential data read out of the memory means.

According to a further aspect of the present invention, there is provided a method for use in an image forming apparatus which performs an image forming operation comprising the steps of: charging a photosensitive drum by applying a predetermined charging voltage thereto; causing the photosensitive drum to bear an electrostatic latent image corresponding to an image to be copied, in a state where the photosensitive drum is charged to have a predetermined surface potential; developing the electrostatic latent image of the photosensitive drum with toner by means of a developing unit; and forming a toner image on a sheet by transferring the developed image from the photosensitive drum to the sheet, wherein the method further comprises the steps of: outputting a value corresponding to a toner density inside the developing unit by means of a toner density sensor; sequentially reading out the photosensitive drum surface potentials corresponding to values of the toner density sensor from a conversion table when the toner density sensor begins to output a value greater than a first predetermined value; changing the surface potential of the photosensitive drum by varying a charging voltage applied to the photosensitive drum on the basis of the readout drum surface potentials; and stopping the image forming operation when the value output by the toner density sensor reaches a second predetermined value.

Additional objects and advantages of the invention will be set forth in the description which follows, and in part will be clear from the description, or may be ascertained by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

One embodiment of the present invention will now be described with reference to the accompanying drawings.

Figure 1:
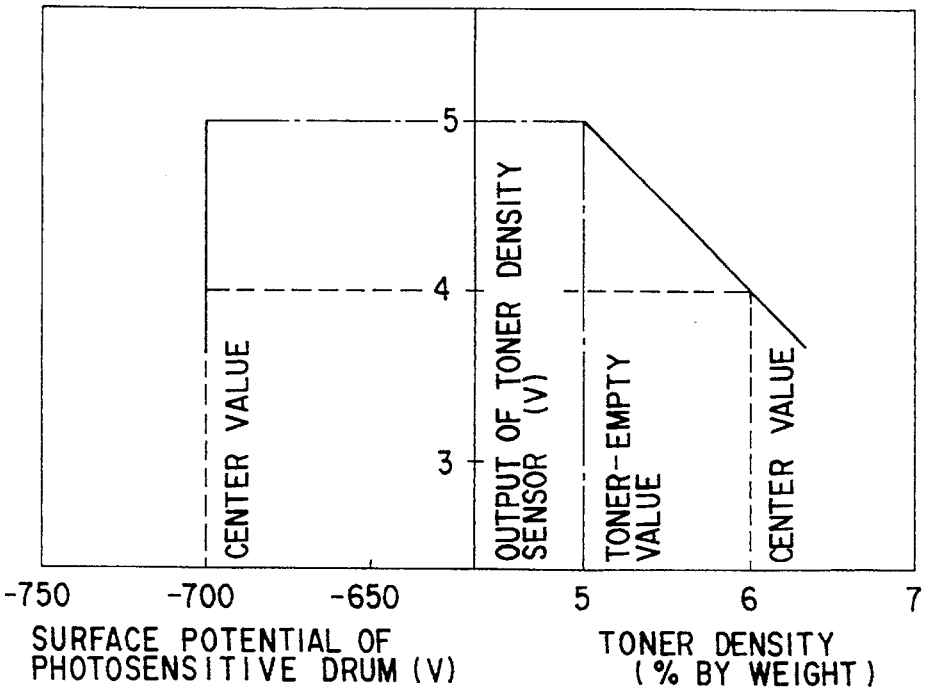
FIG. 1 is a graph showing how the toner density, the output of a toner density sensor and the surface potential of a photosensitive drum are related in the conventional art.
Figure 2:
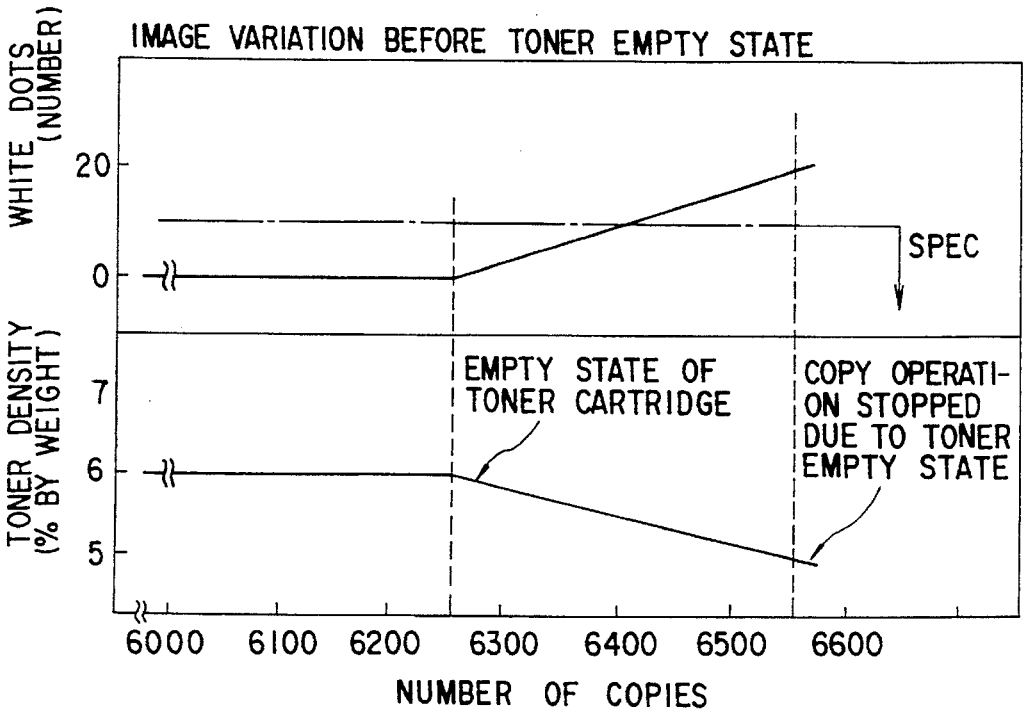
FIG. 2 is a graph showing how, in the conventional art, the toner density and the number of carriers attracted to the photosensitive drum are related before the developing unit is in a toner empty state.
Figure 3:
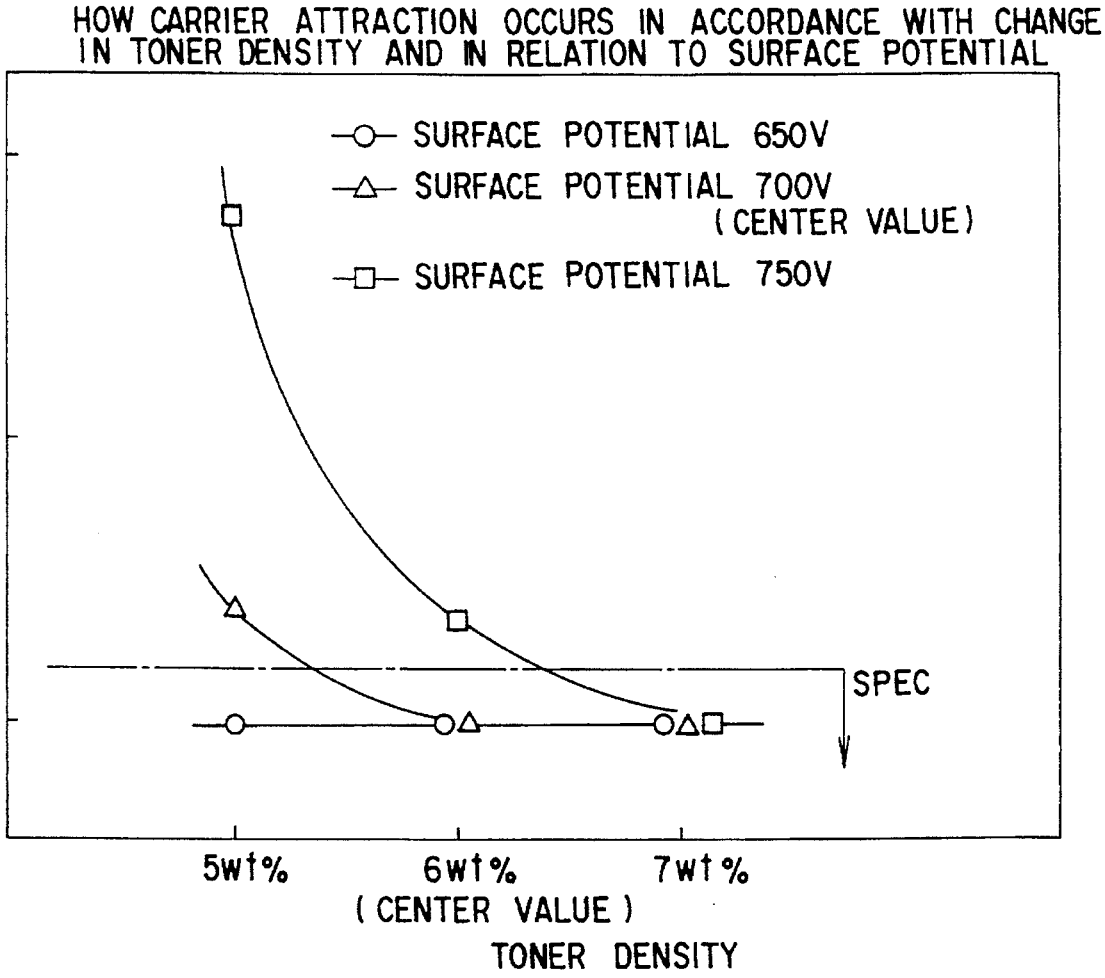
FIG. 3 is a graph showing how, in the conventional art, carriers are attracted to the photosensitive drum in accordance with a change in the toner density, the carriers attracted to the photosensitive drum being illustrated in relation to different surface potentials of the photosensitive drum.
Figure 4:
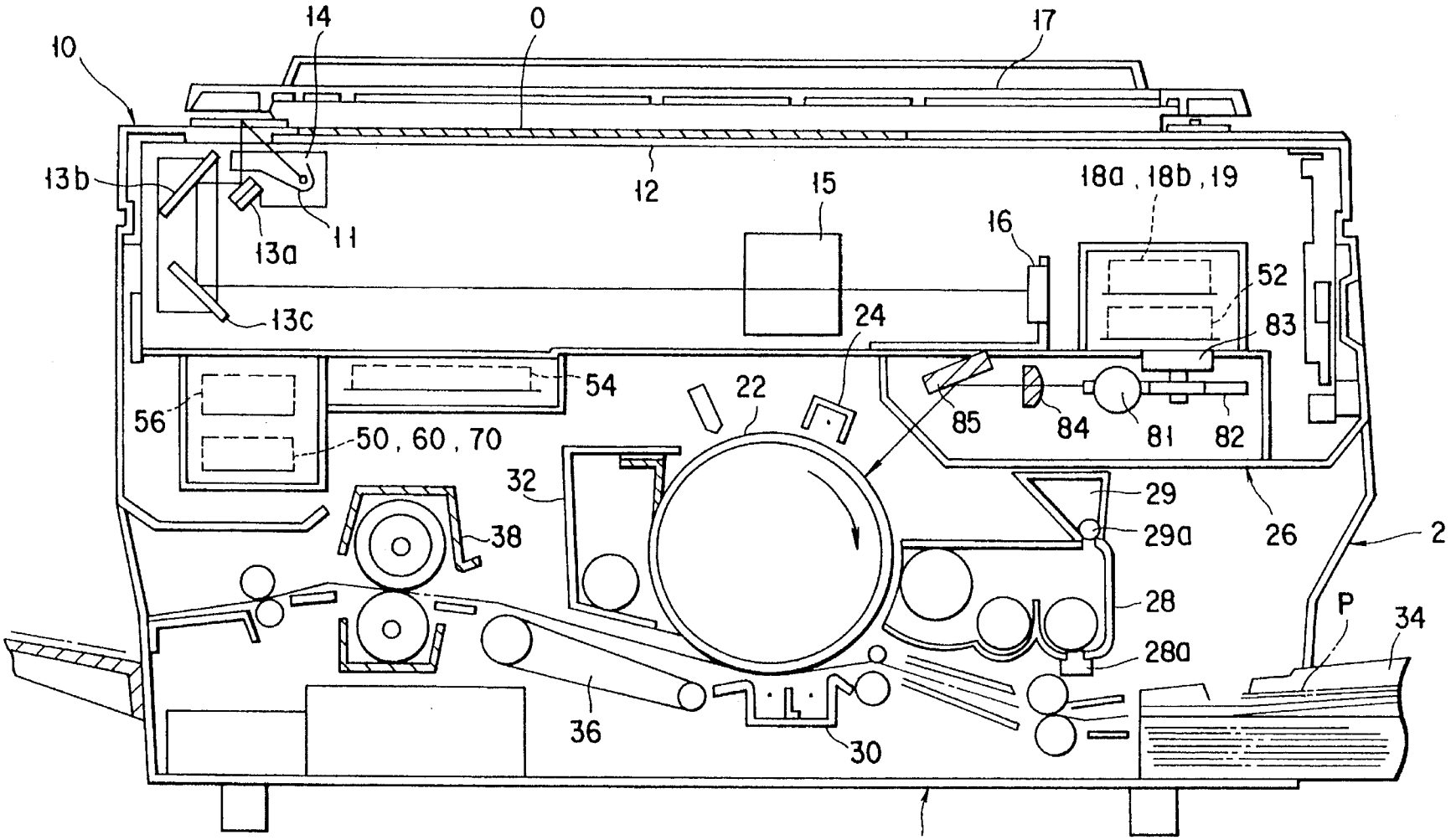
FIG. 4 is a sectional view showing the entire structure of an image forming apparatus according to one embodiment of the present invention.

FIG. 4 is a schematic illustration of the internal structure of an image forming apparatus embodying the present invention. In FIG. 4, a digital copying machine is depicted by way of example.

The image forming apparatus 2 comprises a scanner section 10 for optically reading image information on a document. The image forming apparatus 2 also comprises a printer section 20 (i.e., an image forming section) for outputting image information onto a recording sheet (a copying sheet) in accordance with image signals which are either read by the scanner section 10 or supplied from an external device (not shown).

The scanner section 10 comprises a document table 12 on which an original document O to be copied is placed, a light source 14 for illuminating the original document O placed on the document table 12, and a CCD sensor 16 for photoelectrically converting the light reflected by the original document O, thereby converting the reflected light into image information signals.

A reflector 16 surrounds the light source 14 so that the illuminating light from the light source 14 can be guided to the original document O with high efficiency. A number of mirrors 13*a*, 13*b* and 13*c* and lens 15 are arranged between the light source 14 and the CCD sensor 16. The mirrors 13*a*, 13*b* and 13*c* are employed to change the direction of the optical path along which the light reflected by the document O travels to the CCD sensor 16. The lens 15 is employed for focusing the reflected light onto the light-receiving plane of the CCD sensor 16.

A document push member 17 for bringing the document O into tight contact with the document table 12 is located on the document table 12. The document push member 17 may be replaced with an SDF (a semi-auto document feeder) or an ADF (an auto document feeder) on the basis of the size and copying performance of the image forming apparatus 2.

The printer section 20 comprises a photosensitive drum 22 (an image carrier or an image bearing member). The photosensitive drum 22 is a cylindrical photoelectric conversion element and can be rotated in a desired direction by means of a motor (not shown). The photosensitive drum 22 is charged to have a desired potential. When a light beam is incident on the photosensitive drum 22, the beam-incident portion of the drum 22 varies in potential, thus forming an electrostatic latent image.

A charging unit 24, a laser unit 26, a developing unit (developing means) 28 and a transfer unit 30 are arranged around the photosensitive drum 22 in the order mentioned. The charging unit 24 is constituted by a charging grid for providing the photosensitive drum 22 with a desired surface potential. The laser unit 26 outputs a laser beam (a light beam) and is turned on or off in accordance with image or print signals supplied from an image processing section (to be described later), i.e., in accordance with image information to be copied or output. The developing unit 28 supplies toner (i.e., a visualizing or developing agent) to the electrostatic latent image which is formed on the photosensitive drum 22 by the laser beam emitted from the laser unit 26. In this manner, the electrostatic latent image is developed as a toner image. The transfer unit 30 transfers the toner image from the photosensitive drum 22 onto a recording or copying sheet P (a medium on which an image is formed) supplied from a recording sheet feeding section 34.

The laser unit 26 comprises a semiconductor laser 81 (i.e., a light source), a polygon mirror 82 (i.e., a scanning member) for sequentially deflecting the laser beam emitted from the semiconductor laser 81, a polygon motor 83 (i.e., a scanning motor) for rotating the polygon mirror 82 at a predetermined speed, and optical systems 84 and 85 for guiding the laser beam deflected by the polygon mirror 82 to the photosensitive drum 22. The laser unit 26, incorporating these structural elements, is secured to, and supported by a support frame (not shown) of the main body of the image forming apparatus 2.

A toner density sensor (i.e., a density detecting means) 28*a* is provided inside the developing unit 28.

A toner cartridge 29 is located above the developing unit 28, and toner is supplied from the toner cartridge 29 to the developing unit 28. A toner roller 29*a* rotated by a toner motor (to be described later) is arranged in the toner cartridge 29. The amount of toner supplied to the developing unit 28 corresponds to the time in which the toner roller 29*a* is rotated.

A cleaner unit 32 is arranged around the photosensitive drum 22 such that it is located downstream of the transfer unit 30 with respect to the rotating direction of the photosensitive drum 22. The cleaner unit 32 removes the remaining toner from the surface of the photosensitive drum 22. In addition, the cleaner unit 32 eliminates the different-potential surface portions from the photosensitive drum 22, thus making preparations for the next image formation.

The recording sheet feeding section 34 is located between the developing unit 28 and the transfer unit 30. From this section 34, a copying sheet P to which the toner image is transferred from the photosensitive drum 22 is fed toward the transfer unit 30.

A fixing unit 38 and a conveyor 36 are arranged at a position which is downstream of the transfer unit 30 with respect to the rotating direction of the photosensitive drum 22. To be more specific, the fixing unit 38 and the conveyor 36 are arranged at a position where the copying sheet P bearing the toner image thereon is separated from the photosensitive drum 22. The fixing unit 38 fixes the toner image to the copying sheet P. The conveyor 36 is located between the fixing unit 38 and the transfer unit 30. It conveys the copying sheet P toward the fixing unit 38.

The subject image forming apparatus 2 further comprises a control panel 40 (FIG. 5), a main controller 49 (FIG. 5), an interface (not shown) used for the connection to a memory or an external device, and other structural components.

The control panel 40 is provided for either the scanner section 10 or the printer section 20.

Figure 5:
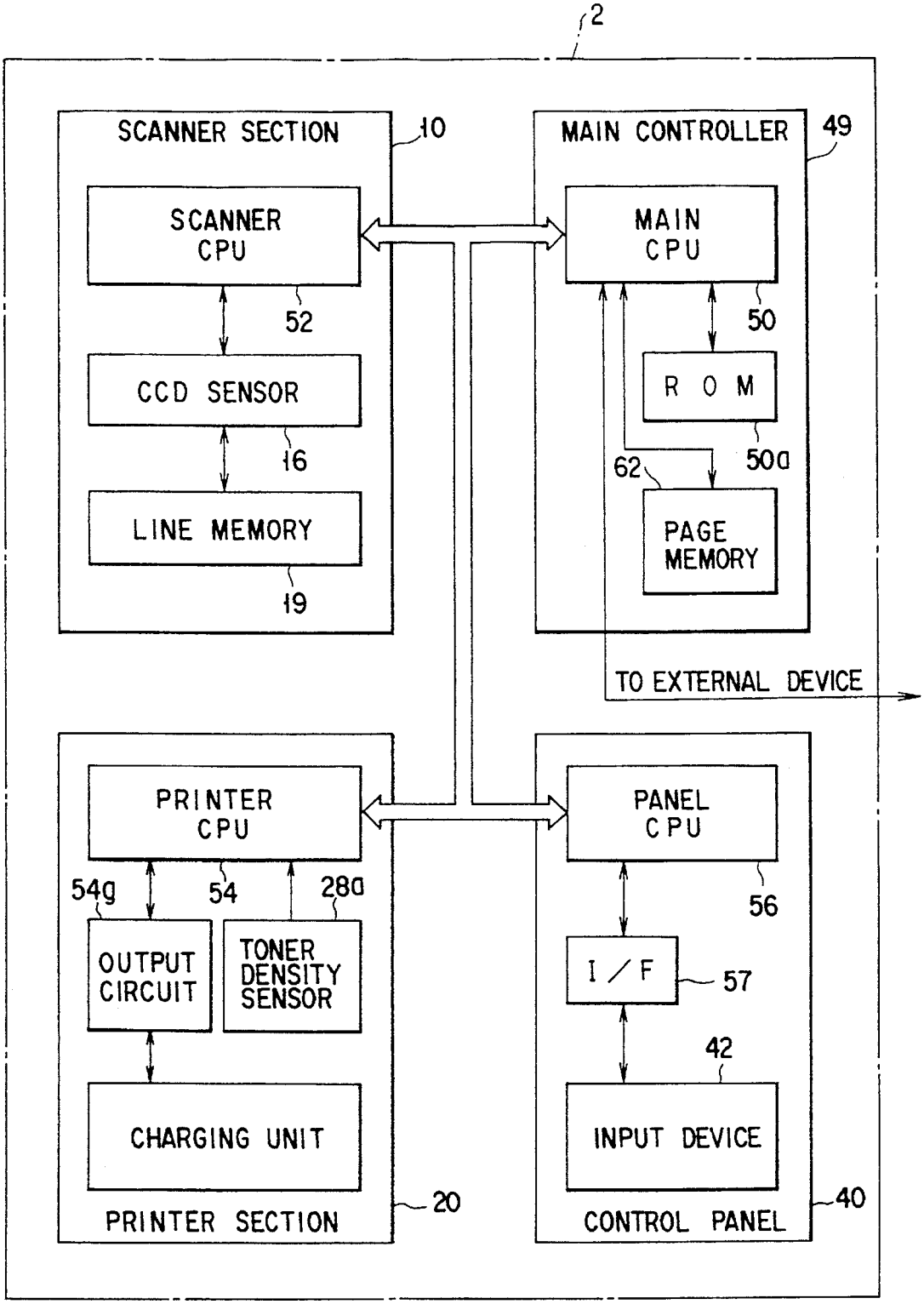
FIG. 5 is a block diagram schematically showing the entire control system employed in the image forming apparatus.

FIG. 5 is a block diagram schematically showing how signals are exchanged in the image forming apparatus 2 shown in FIG. 4, for electrical connection and control. Referring to FIG. 5, the main CPU 50 of the main controller 49 is connected to a scanner CPU 52, a printer CPU 54 and a panel CPU 56. By these CPUs, the scanner section 10, the printer section 20 and the control panel 40 can operate independently or in association with one another.

Figure 6:
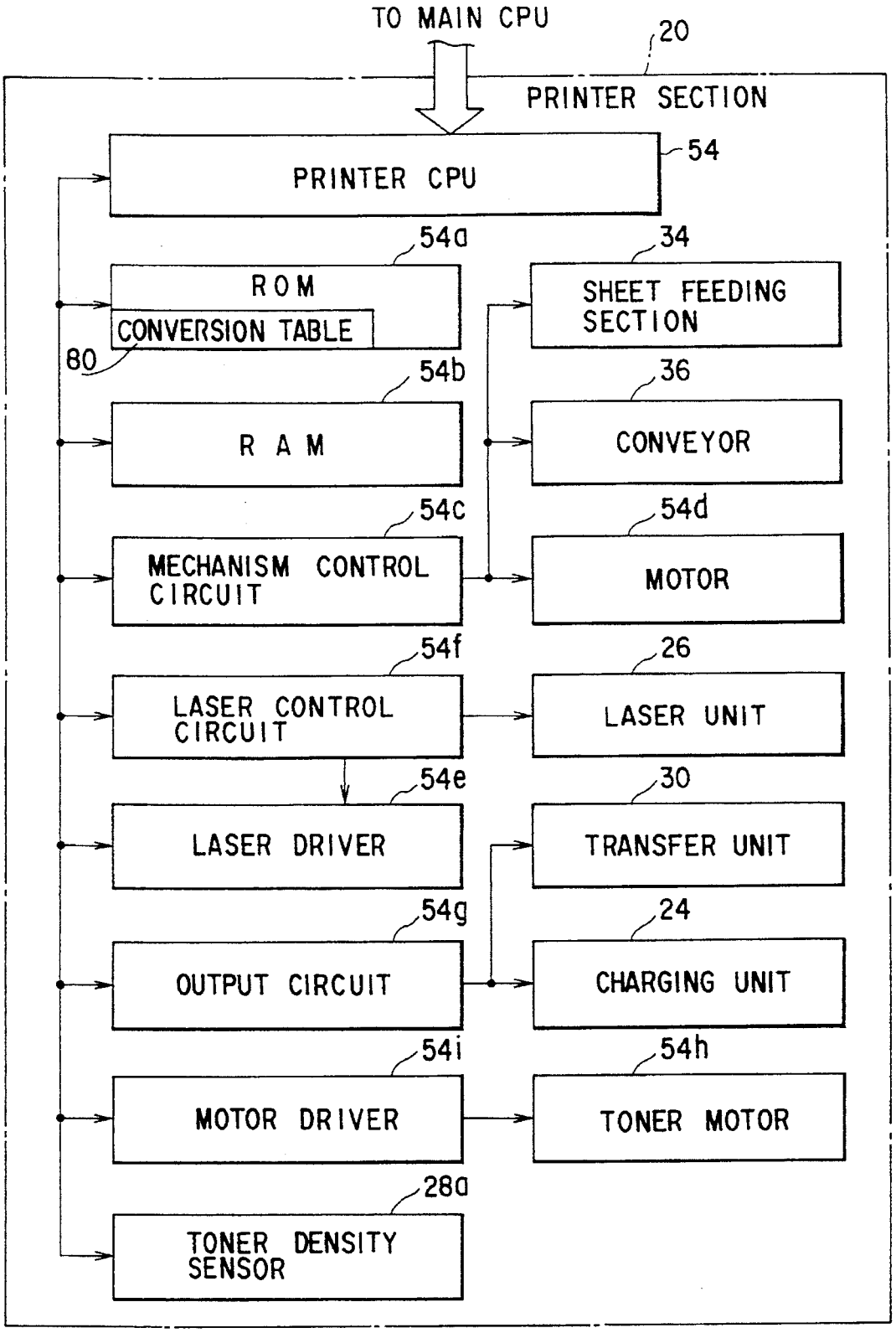
FIG. 6 is a block diagram schematically showing the structure of a printer section.

FIG. 6 shows how signals are exchanged in the printer section 20, for electrical connection and control.

As shown in FIG. 6, the printer section 20 comprises the following structural elements: a printer CPU 54 for controlling the entire printer section 20; ROM 54*a* for storing control programs, etc.; RAM 54*b* for storing data; a sheet feeding section 34; the conveyor 36; a mechanism control circuit 54*c* for controlling driving mechanisms, such as motor 54*d* used for rotating the photosensitive drum 22; a laser control circuit 54*f* for controlling the rotation of the laser unit 26 and for controlling a laser driver 54*e* which turns on or off light-emitting means (not shown); an output circuit 54*g* for supplying a power source voltage to the charging unit 24 and transfer unit 30; a motor driver 54*i* for driving the toner motor 54*h* which rotates the toner roller 29*a;* and the toner density sensor 28*a* mentioned above.

The ROM 54*a* includes a conversion table 80. This conversion table 80 stores data representing predetermined relationships between the output values of the toner density sensor 28*a* and the surface potentials of the photosensitive drum 22.

Figure 7:
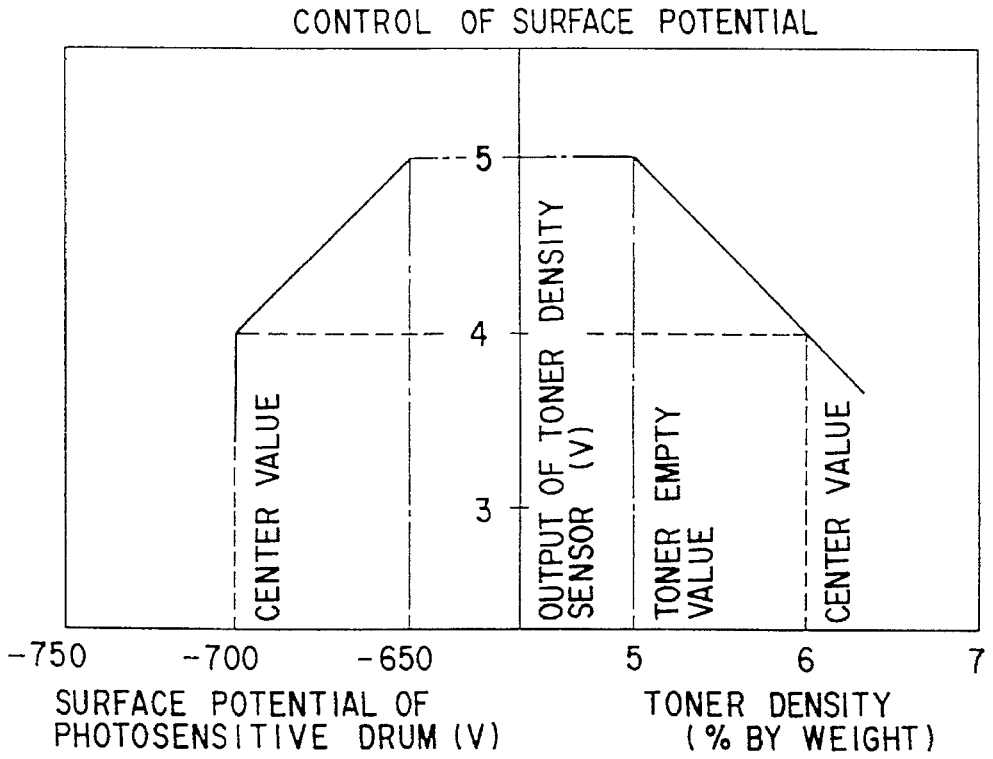
FIG. 7 is a graph showing how the toner density, the output of a toner density sensor and the surface potential of a photosensitive drum are related.

As shown in FIG. 7, the surface potential of the photosensitive drum 22 is normally kept at −700 V by the bias voltage applied by the charging unit 24. When the toner density is low, the bias voltage by the charging unit 24 is decreased such that the surface potential gradually decreases from −700 V to −650 V in accordance with the low toner density.

To be more specific, when the output of the toner density sensor 28*a* exceeds 4 V, the printer CPU 54 determines that the toner density becomes lower than 6% by weight (the toner density center value), and decreases the bias voltage applied by the charging unit 24. As a result, the surface potential of the photosensitive drum 22 begins to decrease from −700 V.

As shown in FIG. 7, the surface potential of the photosensitive drum 22 is gradually varied within the range of −700 V to −650 in accordance with a gradual change in the toner density sensor 28*a* in the range of 4 V to 5 V (5 V corresponds to the toner-empty value).

An operation of the image forming apparatus 2 will now be described in detail.

The image forming apparatus 2 is designed such that it can be used singly as a digital copying machine, an image input apparatus (i.e., a scanner), a printer apparatus, or a facsimile machine; alternatively, the image forming apparatus 2 can be used as a combination of these. An operation of the image forming apparatus 2 will be explained, referring to the case where it is used as a digital copying machine.

First of all, an object to be copied, such as an original document O, is placed on the document table 12 of the scanner section 10. Then, copying conditions are input from the control panel 40. The control panel 40 is controlled by the panel CPU 56, and copying conditions, such as the number of copies to be made or a copying magnification, are input from the control panel 40. When a print key (not shown) is operated, the image shown on the document O is read.

To be more specific, the light source 14 is turned on by a lamp driver (not shown). The light source 14 and the mirrors 13*a,* 13*b* and 13*c* are moved along the document table 12 in accordance with the rotation of the motor (not shown) energized by the mechanism control circuit (not shown). The light source 14 and the mirrors 13*a,* 13*b* and 13*c* are moved at a speed corresponding to the copying magnification. The light beams reflected by the original are sequentially guided to the CCD sensor 16.

The reflected light beams guided to the CCD sensor 16 are converted into analog signals in units of the pixel corresponding to the resolution of the CCD sensor 16. The CCD sensor 16 is energized by a CCD driver (not shown). The analog signals output by the CCD sensor 16 are converted into digital signals by an analog-digital conversion circuit (not shown).

The digital signals, thus obtained, are subjected to shading correction by a shading correction circuit (not shown).

After the shading correction, the digital signals are temporarily stored in a line memory (not shown). The line memory is arranged adjacent to the shading correction circuit, and output signals of the line memory are supplied to a buffer memory and a page memory (neither is shown) at controlled timings.

The digital signals temporarily stored in the line memory (i.e., image data) are controlled in timing in accordance with the control performed by the main CPU 50, and are then transferred to the buffer memory circuit. The digital signals are stored in the page memory in units of the information corresponding to one page, and one pixel of the information is determined by the resolution of the CCD sensor 16.

The image information signals stored in the page memory are read out and output to an image processing circuit (not shown) under the control of the main CPU 50. The image information signals are converted into print signals after they are subjected to processing, such as filtering, trimming, masking, mirror image creation, italicization, enlargement, reduction, edge emphasis, or character determination. The print signals are output to the laser control circuit 54*f* in units of one pixel explained above under the control of the printer CPU 54. From the laser control circuit 54*f,* the image signals are supplied to the printer section 20, which is energized under the control of both the main CPU 50 and the printer CPU 54. The image signals turn on or off the light emitting means (not shown) of the laser unit 26 energized by the laser driver 54*e*, thereby controlling the emission of the laser beam. Needless to say, the emission of the laser beam is controlled in units of the pixel explained above.

In the printer section 20, the motor 54*d* is energized under the control of the main CPU 50 when the print key (not shown) is turned on. As a result, the photosensitive drum 22 is rotated. In addition, the photosensitive drum 22 is electrically charged by the charging unit 24 energized by the output circuit 54*g*, such that the surface potential of the photosensitive drum 22 is kept at −700 V (center value). Further, a copying sheet P is fed from the sheet feeding section 34 by means of the solenoid and clutch energized by the mechanism control circuit 54*c*.

A laser beam, the emission of which is controlled by the laser control circuit 54*f*, is radiated onto the surface of the photosensitive drum 22, thereby forming an electrostatic latent image on the photosensitive drum 22. The electrostatic latent image is visualized by the toner supplied from the developing unit 28. The resultant toner image is transferred by the transfer unit 30 from the photosensitive drum 22 to the copying sheet P.

The copying sheet P bearing the toner image thereon is conveyed to the fixing unit 38 by the conveyor 36, and the toner image is fixed to the copying sheet P. After the toner image is fixed, the copying paper P is discharged from the image forming apparatus 2 and guided onto a discharge tray or a sorter located outside of the apparatus 2.

A description will now be given of how the surface potential of the photosensitive drum 22 is controlled by the printer CPU 54 when the toner density becomes low, i.e., how the surface potential is controlled during the period between the time when the toner cartridge 29 becomes empty and the toner density of the developing unit 28 begins to lower and the time when the copying operation stops due to the toner empty state.

The printer CPU 54 checks the output of the toner density sensor 28*a*. When the output is lower than the toner density center value, the printer CPU 54 decreases the output of charging unit 24 in accordance with the low output, thereby lowering the surface potential of the photosensitive drum 22.

To be more specific, when the output of the toner density sensor 28*a* exceeds 4 V, the printer CPU 54 determines that the toner density becomes lower than 6% by weight (the toner density center value), and decreases the voltage applied by the charging unit 24 such that the surface potential of the photosensitive drum 22 decreases from −700 V.

In this case, the surface potential of the photosensitive drum 22 is gradually varied within the range of −700 V to −650 in accordance with a gradual change in the toner density sensor 28*a* in the range of 4 V to 5 V (corresponding to the toner-empty value), as shown in FIG. 7.

Figure 8:
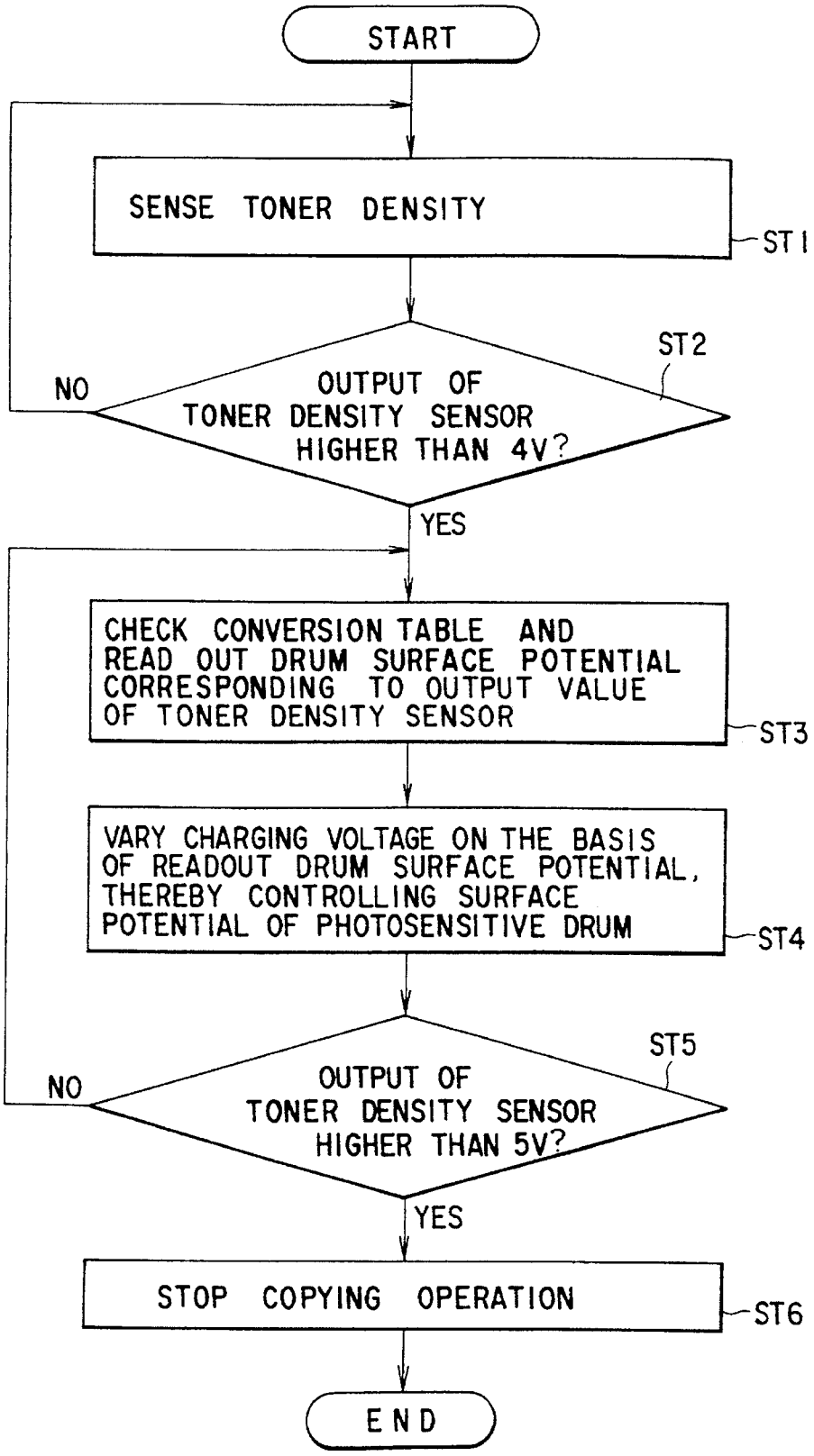
FIG. 8 is a flowchart explaining how the surface potential of a photosensitive drum is varied when the toner density is low.

With reference to the flowchart shown in FIG. 8, a more detailed description will be given as to how the surface potential of the photosensitive drum 22 is controlled by the printer CPU 54 when the toner density becomes low.

When the output of the toner density sensor 28*a* exceeds 4 V (ST1, ST2), the printer CPU 54 determines that the toner density becomes lower than 6% by weight (the toner density center value). The printer CPU 54 checks the conversion table 80 of the ROM 54*a* and reads out the surface potential corresponding to the output value of the toner density sensor 28*a* (ST3).

Subsequently, the printer CPU 54 varies the charging voltage of the charging unit 24 on the basis of the readout surface potential, thereby controlling the surface potential of the photosensitive drum 22 (ST4).

Further, the printer CPU 54 checks whether or not the output of the toner density sensor 28*a* becomes higher than 5 V (ST5). If the output of the toner density sensor 28*a* is lower than 5 V, the flow returns to step ST3. Conversely, if the output of the toner density sensor 28 exceeds 5 V, the printer CPU 54 determines that the toner in the toner cartridge 29 has been completely consumed, and stops the copying operation (ST6).

In this manner, the surface potential of the photosensitive drum 22 is gradually varied within the range of −700 V to −650 in accordance with a gradual change in the toner density sensor 28*a* in the range of 4 V to 5 V (corresponding to the toner-empty value), as shown in FIG. 7.

As described above, according to the present invention, the toner density sensor detects the state where no toner is contained in the toner cartridge and the toner density in the developing unit is low. In accordance with the detection output of the toner density sensor, the surface potential of the photosensitive drum is decreased.

To be more specific, the printer CPU checks the output of the toner density sensor. When the output is lower than the toner density center value, the printer CPU decreases the voltage of the charging unit such that the surface potential of the photosensitive drum decreases.

As a result, the carriers are prevented from being attracted to the photosensitive drum during the period between the time when the toner cartridge becomes empty and the time when the copying operation stops due to the toner empty state. Hence, the images formed during that period are not poor in quality.

In the case where the output of the toner density sensor is equal to the toner density center value (i.e., 6% by weight) and the surface potential of the photosensitive drum is equal to the center value (i.e., 700 V), no carrier is attracted to the photosensitive drum. Even if the output of the toner density sensor becomes lower than the toner density center value, the carriers are prevented from being attracted to the photosensitive drum by lowering the surface potential of the photosensitive drum.

Figure 9:
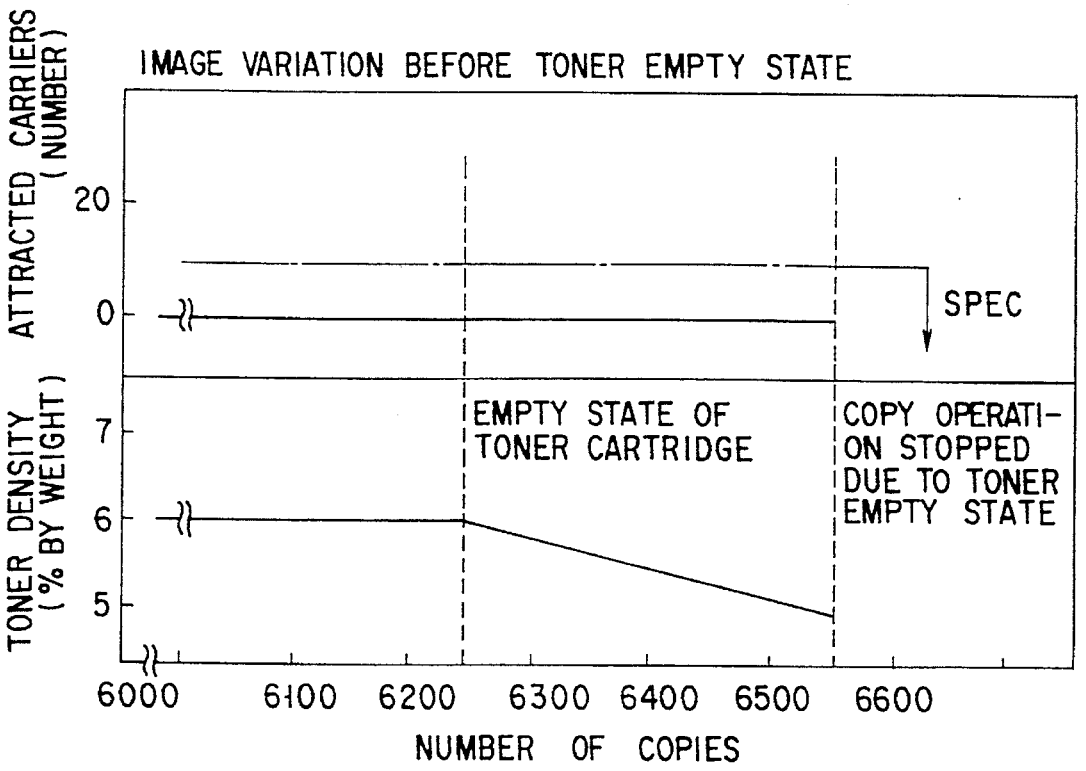
FIG. 9 is a graph showing how the toner density and the number of carriers attracted to the photosensitive drum are related before the developing unit is in the toner empty state.

As shown in FIG. 9, according to the present invention, the carriers are prevented from being attracted to the photosensitive drum during the period between the time when the toner cartridge becomes empty and the toner density begins to decrease and the time when the copying operation stops due to the toner empty state. Hence, the images formed during that period are not poor in quality.

When the surface potential of the photosensitive drum is decreased, the carriers are not attracted to the photosensitive drum. In addition, a smaller amount of toner attaches to the photosensitive drum. This phenomenon can be utilized for forming a low-density toner image on the photosensitive drum, thereby decreasing the amount of toner required.

In comparison with the amount of toner required for forming an ordinary-density image, the amount of toner required for forming a low-density image is small. This toner save mode can be selected by operating an input device 42 of the control panel 40. In the toner save mode, the printer CPU 54 reads a predetermined value from the conversion table 80 of the ROM 54*a*, and controls the charging unit 24 on the basis of the read value such that the photosensitive drum is charged to have a potential lower than the normal potential level (−700 V). Since the toner consumption can be reduced in comparison with the normal copying operation, the same toner cartridge 29 can be used for a long time. This toner save mode may be put to practice in combination with the control based on the toner density sensor. That is, when the toner density of the developing unit 28 becomes low when the toner save mode is selected, data is read from the conversion table 80 of the ROM 54*a* and the charging output is further decreased on the basis of the read data.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

an image bearing member for bearing an electrostatic latent image formed thereon;

means, storing a developing agent including toner and carriers, for developing the electrostatic latent image formed on the image bearing member by supplying the toner to the electrostatic latent image;

means, provided in the developing means, for sensing a toner density inside the developing means and for producing a sensing output; and means for charging the image bearing member such that the image bearing member has a constant surface potential when the sensing output is under a predetermined value, and for charging the image bearing member such that the image bearing member has a variable surface potential corresponding to the sensing output when the sensing output is over the predetermined value.

2. An image forming apparatus according to claim 1, wherein said charging means charges the image bearing member such that the surface potential of the image bearing member is decreased in magnitude in accordance with a decrease in the toner density sensed by the density sensing means.

3. An image forming apparatus according to claim 1, wherein said charging means begins to gradually decrease the magnitude of the surface potential of the image bearing member when the toner density sensed by the density sensing means becomes lower than a reference value, and continues to gradually decrease the magnitude of the surface potential until the toner density sensed by the density sensing means becomes a value corresponding to a toner empty state of the developing means.

4. An image forming apparatus comprising:

an image bearing member for bearing an electrostatic latent image formed thereon;

means for charging the image bearing member;

means, storing a developing agent including toner and carriers, for developing the electrostatic latent image formed on the image bearing member by supplying the toner to the electrostatic latent image;

means, provided in the developing means, for sensing a toner density inside the developing means and for producing a sensing output;

means for storing data on toner densities inside the developing means and data on surface potentials of the image bearing member in association with each other, said storing means storing data representing a constant surface potential of the image bearing member when the toner densities are higher than a predetermined value, and storing data representing a surface potential of the image bearing member which decreases in magnitude in accordance with a decrease in a toner density, when the toner densities are lower than the predetermined value;

readout means for reading out one surface potential data corresponding to the toner density sensed by the density sensing means by referring to the sensing output from the density sensing means; and means for controlling the charging means to charge the image bearing member such that the surface potential corresponds to the surface potential data read out by the readout means.

5. A method for use in an image forming apparatus which performs an image forming operation comprising the steps of:

charging a photosensitive drum by applying a predetermined charging voltage thereto;

causing the photosensitive drum to bear an electrostatic latent image corresponding to an image to be copied, in a state where the photosensitive drum is charged to have a predetermined surface potential;

developing the electrostatic latent image of the photosensitive drum with toner using a developing unit; and forming a toner image on a sheet by transferring the developed image from the photosensitive drum to the sheet, wherein said method further comprises the steps of outputting a value corresponding to a toner density inside the developing unit using a toner density sensor;

sequentially reading out from a conversion table photosensitive drum surface potentials which decrease in magnitude in accordance with an increase in the output value from the toner density sensor, when the toner density sensor begins to output a value greater than a first predetermined value;

changing the surface potential of the photosensitive drum by varying a charging voltage applied to the photosensitive drum on the basis of the readout drum surface potentials; and stopping the image forming operation when the value output by the toner density sensor reaches a second predetermined value.

6. An image forming apparatus according to claim 1, wherein said predetermined value corresponds to a toner density at which the carriers of the developing agent begin to attach to the image bearing member.

7. An image forming apparatus according to claim 4, wherein said predetermined value is a toner density at which carriers of the developing agent begin to attach to the image bearing member.

8. A method according to claim 5, wherein said developing unit contains a developer agent made up of toner and carriers, and said first predetermined value corresponds to a toner density at which the carriers of the developing agent begin to attach to the image bearing member.

* * * * *